US008136499B2

(12) United States Patent
Menzel et al.

(10) Patent No.: US 8,136,499 B2
(45) Date of Patent: Mar. 20, 2012

(54) COVER ARRANGEMENT FOR A HAND-HELD POWER TOOL

(75) Inventors: Johannes Menzel, Wernau (DE); Jorg Schlossarczyk, Winnenden (DE); Kai-Ulrich Machens, Stuttgart (DE); Bernd Andress, Erdmannhausen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 1676 days.

(21) Appl. No.: 11/308,878

(22) Filed: May 19, 2006

(65) Prior Publication Data

US 2007/0034187 A1 Feb. 15, 2007

(30) Foreign Application Priority Data

Jun. 4, 2005 (DE) ..... 10 2005 025 707

(51) Int. Cl.
*F02B 77/00* (2006.01)

(52) U.S. Cl. ..... 123/195 C; 123/195 A; 123/195 R; 248/629

(58) Field of Classification Search ..... 123/195 A, 123/195 C, 195 R
See application file for complete search history.

(56) References Cited

U.S. PATENT DOCUMENTS 3,430,084 A * 2/1969 Hall et al. ..... 310/50
4,880,713 A * 11/1989 Levine ..... 429/100
4,913,112 A * 4/1990 Iida ..... 123/198 E

* cited by examiner

*Primary Examiner* — Noah Kamen
*Assistant Examiner* — Hung Q Nguyen
(74) *Attorney, Agent, or Firm* — Gudrun E. Huckett

(57) ABSTRACT

A cover arrangement of a hand-held power tool has a cover having at least one fastening element for connecting the cover to an additional component of the power tool. The cover has a wall component having a shape-elastic yielding support forming a monolithic part of the cover. The at least one fastening element is arranged on the support.

12 Claims, 3 Drawing Sheets

COVER ARRANGEMENT FOR A HAND-HELD POWER TOOL

BACKGROUND OF THE INVENTION

The invention relates to a hand-held power tool such as a chain saw, a trimmer, a cut-off machine or the like. In operation, the power tools act as a sound source whose noise emission may not surpass a certain limit. In particular, a drive motor of the power tool that is embodied as an internal combustion engine can generate a significant noise level that is transmitted as structure-borne sound to adjoining components and that excites the adjoining components to perform vibrations that also generate sound.

In known configurations, a cover is used to cover, for example, the cylinder or other parts of the power tool. By means of fixed clamping locations of the cover, for example, in the form of screw connections, the structure-borne sound is transmitted from the crank cases and cylinder of the drive motor onto the cover. The covers that are comprised of thin wall sections are excited to generate vibrations. Wall sections of the cover that have large surface areas have the tendency to produce vibrations that are transmitted as their own structure-borne sound to the surroundings and thus contribute to the noise load.

In known configurations, a rubber bearing is used for preventing such noise emission at the fastening location of the cover or the screw connection; the rubber bearing is provided to prevent transmission of high-frequency vibrations into the cover. Such rubber bearings increase the number of parts and the assembly costs.

SUMMARY OF THE INVENTION

It is an object of the present invention to provide a cover arrangement of a hand-held power tool with improved acoustic decoupling achieved at minimal expenditure.

In accordance with the present invention, this is achieved in that the fastening element is arranged on a shape-elastic yielding support that is a monolithic part of a wall component of the power tool.

A cover arrangement is proposed in which the cover is connected by at least one fastening element to an additional component of the power tool. The fastening element is arranged on a shape-elastic yielding support. The support is a monolithic part of a wall component of the power tool. The wall component can be a part of the motor housing for the like and is preferably a wall section of the cover to be fastened, wherein the support is formed as a unitary part of the wall section of the cover. The unitary or monolithic configuration of the support and the wall component enables manufacture in a single process step without additional mounting labor. The configuration of the support as a shape-elastic yielding part means that, taking into account the elastic material properties, it is configured geometrically such that upon sound-caused vibration excitation in the support an independent deformation decoupled from the wall component is generated. This shape-elastic yielding action enables a vibrational relative movement of the fastening element relative to the wall component; this provides sound-decoupling, in particular, in a high-frequency range. The sound transmission into the cover is prevented effectively so that wall sections of the cover are loaded with significantly reduced structure-borne sound. The sound emission originating at the cover is reduced effectively.

Depending on the spatial conditions and the occurring operating loads, different configurations of the support can be expedient. For example, the support can be configured as an elastic clip or the like that is connected with both ends to the wall component; its middle section is provided with the fastening element. In a preferred configuration, the support is a cantilever connected with one end to the wall component and provided at its free end with the fastening element. The cantilever configuration enables elastic deformations and thus decoupling of vibration excitation in all three axes in space.

In an expedient configuration, the support has different flexural strengths about different cross-sectional axes. In the case of different excitation vibrations in different spatial directions, it is thus possible to provide a properly matched decoupling action that is direction-oriented.

In a preferred embodiment, the support has a curved or angled configuration so that the fastening element, at least relative to portions of the support, is eccentrically arranged. This portion is subjected not only to a bending load but also to a torsion load. The torsion deformation in the support is used also for decoupling in addition to bending deformation.

Expediently, the support extends at least section-wise parallel to the wall component that carries it. This makes possible a correspondingly long and thus soft configuration of the support; at the same time, the fastening element provided at its end is near the exterior side of the wall component. In the case of a compact configuration, the shape-related soft configuration of the support can also provide decoupling of comparatively low excitation frequencies.

In a preferred embodiment, a section of the support extending parallel to the wall component is separated by lateral slots from the wall component and is positioned in the plane of the wall component. The slots enable a free relative movement of the parallel-extending section relative to the wall component extending in the same plane and surrounding it. The support section that is positioned in the same plane as the wall component is integrated into the surface contour. The smooth surface contour prevents deposition of dirt as well as the risk of damage when impacted and, moreover, provides a visually pleasing appearance.

The end of the slots are preferably in the form of rounded widened portions. Stress peaks in the end area of the slots are prevented so that the carrying capacity of the support is increased.

In a preferred alternative, the section of the support that extends parallel to the wall component is positioned at a spacing to the plane of the wall component. The wall component requires no opening for receiving the aforementioned section and can therefore be designed in a continuous tight configuration so that penetration of dirt is prevented. For producing this arrangement by injection molding, comparatively simple molds without additional mold slides can be used.

In an expedient configuration, the free end of the support is positioned at a spacing from the wall component wherein the fastening element is arranged on an inner side of the free end facing the wall component. For obtaining a compact configuration, the fastening element arranged on the inner side of the support is positioned near the cover. At the same time, the embodiment of the support extending to the exterior has a corresponding elongate configuration with a corresponding distinctive yielding action.

The fastening element can be a locking pin, a quick-connect closure or the like and is preferably configured as an eye-shaped screw receptacle and, in particular, is a monolithic or unitary part of the free end of the support. When the screw is tightened, the eye-shaped screw receptacle is spatially secured. As a result of the intimate, especially monolithic, connection with the support, a clearly defined vibrating deformation in the support itself is provided so that the support with regard to its stiffness can be matched constructively precisely to the occurring excitation vibrations.

Depending on the type of application, it can be expedient to produce the wall component and the support secured thereat as an integral injection-molded part from two different appropriately matched plastic materials. Preferably, the support and the wall component are produced from the same thermoplastic material by injection molding. The manufacturing and material expenditure is minimized while the elastic yielding action of the fastening element can be adjusted by means of the geometric configuration of the support.

In a preferred configuration a guide with play is provided for an edge of the cover. The guide ensures during mounting precise positioning. When static or impact loads occur in operation, sliding or slipping of the cover is prevented by the guide while the play in the guide enables a vibrational relative movement with minimal amplitude and ensures a high-frequency acoustic decoupling and prevents structure-borne sound transmission.

DESCRIPTION OF THE PREFERRED EMBODIMENTS

Figure 1:
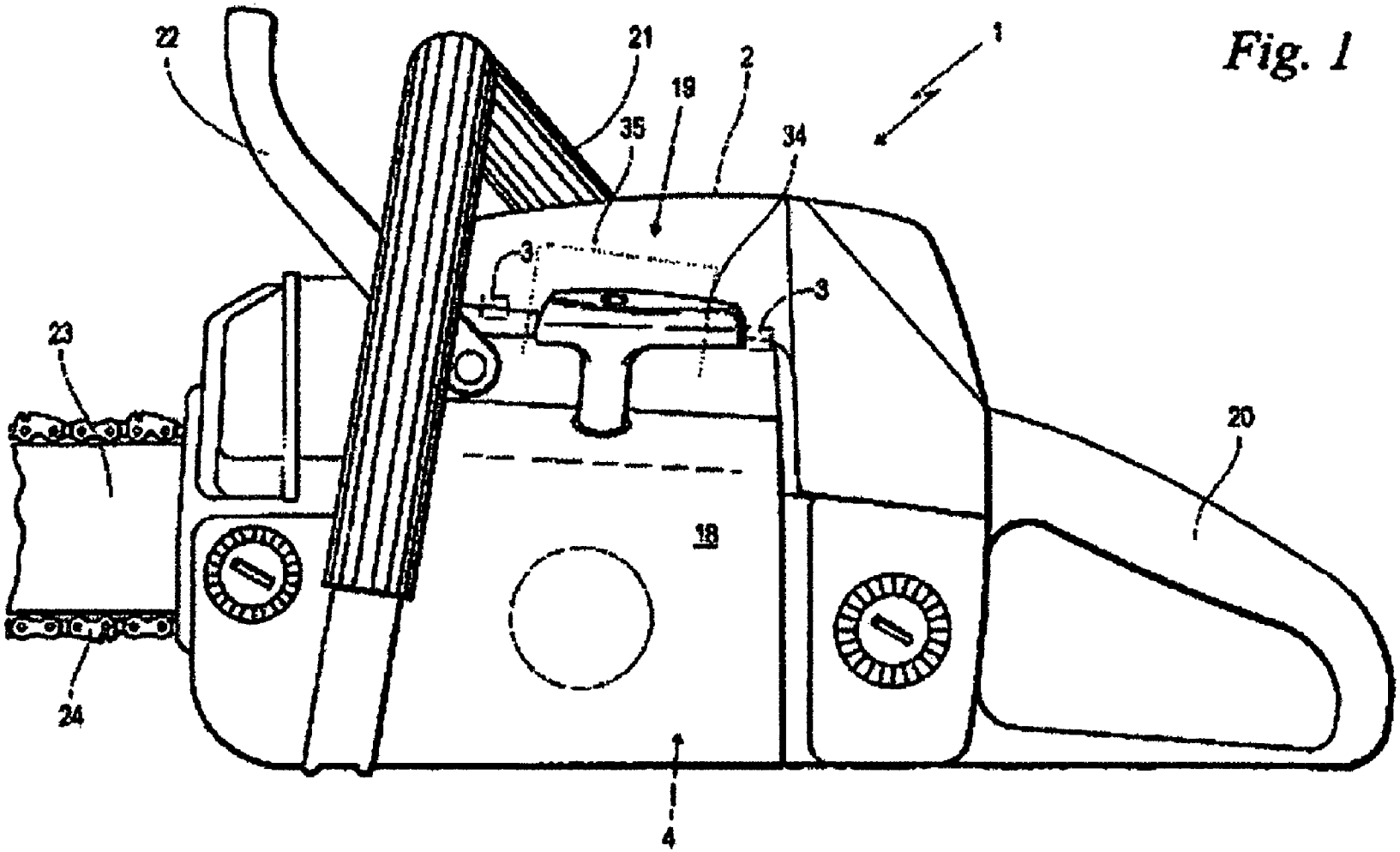
FIG. 1 illustrates in a side view a portion of a hand-held power tool in the form of a chain saw having a motor cover that is connected by schematically shown fastening elements to the tool housing.

FIG. 1 shows a hand-held power tool 1 exemplified by a chain saw that is driven by an internal combustion engine 19 (not shown in detail). It is also possible to use the cover arrangement on a trimmer, a cut-off machine or the like. The internal combustion engine 19 is arranged in a housing 18 and drives a saw chain 24 circulating about a guide bar 23 that is shown only partially. On the end of the housing 18 facing away from the guide bar 23, a rear handle 20 is provided; at the end facing the guide bar 23, the housing 18 has an additional front handle 21 surrounding the housing 18. A lever 22 of a brake device for the saw chain 24 is arranged between the front handle 21 and the guide bar 23; it is supported pivotably on the housing 18 and, as needed, can be actuated by the hand gripping the front handle 21. For starting the internal combustion engine 19, a pull rope starter 34 is provided.

A cover arrangement according to the invention is provided where a cover 2 covers a schematically indicated cylinder 35 of the internal combustion engine 19. The cover 2 is attached by means of schematically indicated fastening elements 3 on an additional component 4 of the power tool 1. In the illustrated embodiment, the additional component 4 is the housing 18; however, the additional component can also be another part of the power tool 1. The cover 2 that is illustrated in an exemplary fashion as a motor cover can also be another cover, for example, for covering a carburetor or an air filter; in this case, the fastening elements 3 can be configured in the same way as explained in connection with the embodiments described in the following.

Figure 2:
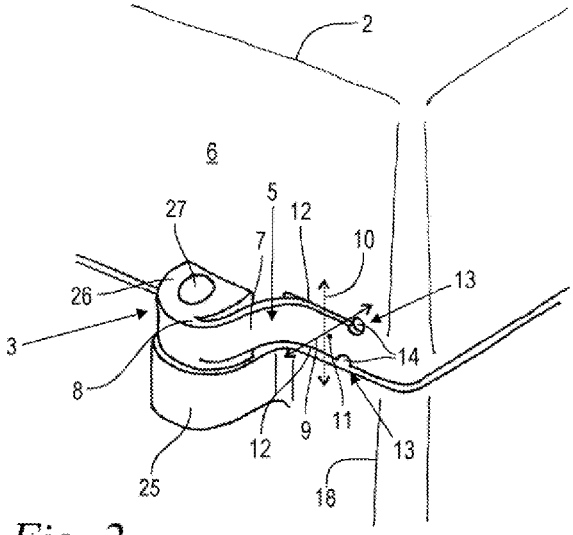
FIG. 2 is a perspective schematic illustration of the cover arrangement according to FIG. 1 in the area of the fastening element secured to an elastic support.

FIG. 2 shows a schematic perspective illustration of the cover 2 according to FIG. 1 in the area of a fastening element 3. The fastening element 3 is monolithic with the shape-elastic yielding support 5 and is comprised of the same material; the support 5 itself is monolithic with the cover 2 and made from the same material as the cover 2. The cover 2 with the support 5 and the fastening element 3 as well as the housing 18 with the screw flange 25 are manufactured as a monolithic part and of the same thermoplastic material by injection molding, respectively. In the illustrated embodiment, the fastening element 3 is an eye-shaped screw receptacle 26 with a central screw hole 27 and rests against a screw flange 25 of the housing 18. The screw flange 25 is essentially rigid and formed as a monolithic part of the wall of the housing 18. The shape-elastic yielding support 5 is formed as a part of the wall component 6 that is a flat wall section of the cover 2. A reverse arrangement can also be expedient in which the wall component 6 with the support 5 and the fastening element 3 is correlated with the housing 18 or the additional component 4 (FIG. 1) of the power tool while the cover 2 is provided with the rigid screw flange 25. Instead of the configuration with screw flange 25 and eye-shaped screw receptacle 26, it is also possible to provide a snap-on connection or the like.

In the wall component 6 of the cover 2, two substantially parallel extending slots 12 are provided whose ends 13 have a rounded widened portion 14. In the area of the rounded widened portions 14, the support 5 is connected with one end to the wall component 6 of the cover 2; its opposite end is a free end 8 so that the support 5 is configured as a cantilever 7. The screw receptacle 26 is formed as a monolithic part on the free end 8 of the cantilever 7. A configuration may also be expedient where both ends of the support 5 are attached to the wall component 6 wherein the fastening element 3, for example, is arranged in a central area of the elastic support 5.

The illustration according to FIG. 2 shows that the support 5 is embodied as an elastic tongue having an approximately rectangular cross-section. Relative to a cross-sectional axis 10 extending in the vertical direction, a cross-sectional height is provided that is greater than a cross-sectional width measured in the direction of a transversely positioned cross-sectional axis 9. The flexural strength of the cantilever 7 in the direction of the cross-sectional axis 9 is significantly less than in the direction of the cross-sectional axis 10. It can also be expedient to provide a square or a round cross-section of the support 5 having direction-independent identical flexural strength.

Figure 3:
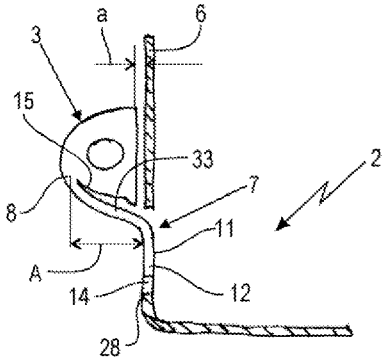
FIG. 3 is a longitudinal section of the arrangement according to FIG. 1 showing details regarding a support section positioned within the plane of the wall.

Details of the section 11 of the support 5 (FIG. 2) extending parallel to the wall component 6 are illustrated in the longitudinal section illustration of FIG. 3. Accordingly, the parallel-extending section 11 is located within the plane of the surrounding wall component 6. The section 11 is elasto-mechanically decoupled from the wall component 6 by means of the U-shaped extension of the slot 12, wherein the two ends of the U-shaped slot 12 open into the rounded widened portions 14. This area forms the end 28 of the section 11 at the cover 2 which end 28 provides a one-side securing action of the cantilever 7.

A section 33 of the cantilever 7 adjoins at an angle the section 11 extending parallel to the wall component 6; the section 33 extends all the way to the free end 8. The angled part between the two sections 11, 33 is rounded. It is also possible to provide an arc-shaped curved configuration or also a sharp-edged angled configuration.

The free end 8 of the cantilever 7 is positioned at a spacing A relative to the wall component 6 of the cover 2. In this area, the cantilever 7 extends at a slant relative to the surface of the wall component 6 and has an inner side 15 facing the wall component 6. In the area of the free end 8, an approximately parallel extension of the cantilever 7 relative to the wall component 6 can also be advantageous. The fastening element 3 is arranged on the inner side 15 of the free end 8 facing the wall component 6. Between the fastening element 3 and the outer side of the wall component 6 there remains a minimal spacing a. As a result of the elastic yielding action of the cantilever 7 the fastening element 3 can swing freely in any spatial direction relative to the wall component 6 of the cover 2.

Figure 4:
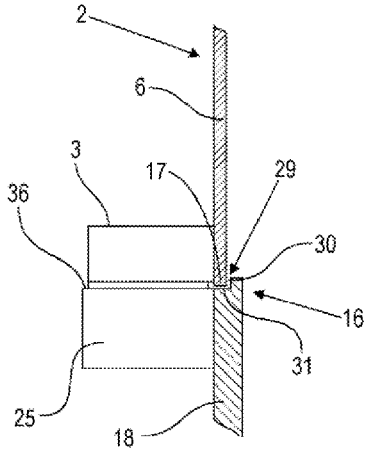
FIG. 4 is a cross-section illustration of the arrangement according to FIGS. 2 and 3 in the area of the fastening element showing a guide for the edge of the cover.

The cross-sectional illustration of the arrangement according to the invention as shown in FIG. 4 shows that the fastening element 3 rests flat on the screw flange 25 of the housing and is fixedly connected thereto by a screw connection. The screw flange 25 projects laterally past the fastening element 3 and surrounds it with an edge 36 provided as a positional securing means. An edge 31 of the housing 18 facing the cover 2 is provided with an undercut 30 in which the free edge 17 of the cover 2 is received. Between the undercut 30 and the edge 31 of the housing 18 as well as the free edge 17 of the wall component 6 of the cover 2 a gap 29 is provided so that a guide 16 with play is formed for the edge 17 of the cover 2; lateral sliding or slipping of the cover 2 is prevented.

Figure 5:
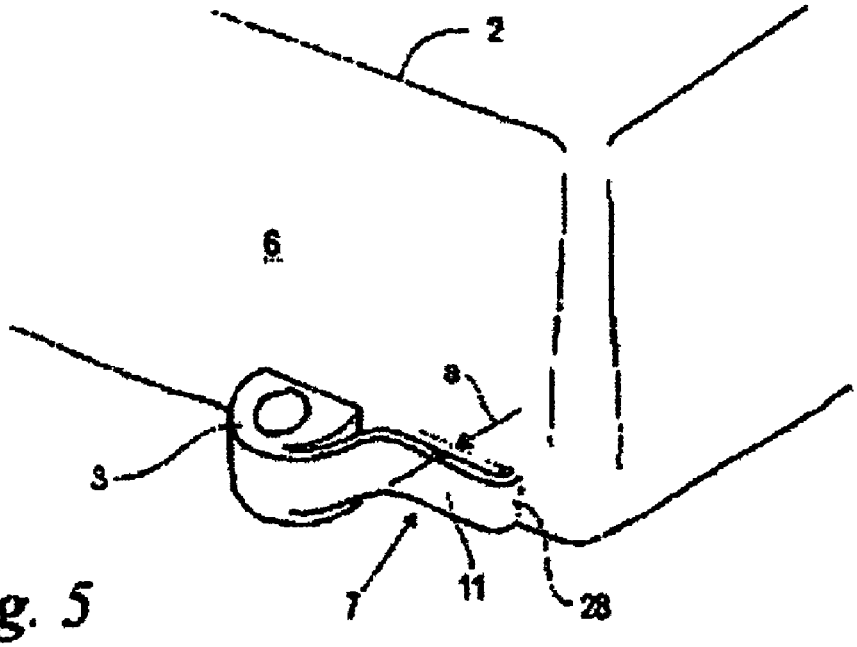
FIG. 5 is a variant of the arrangement according to FIG. 2 in which the support of the fastening element extends parallel to the exterior of the cover wall.

According to FIG. 5, an alternative configuration of the invention is provided in which the wall component 6 of the cover 2 has a continuous uninterrupted configuration of the wall surface in the area of the cantilever 7. The end 28 of the cantilever 7 at the cover 2 projects transversely away from the wall surface of the wall component 6 and passes by means of an angled part into the section 11 of the cantilever 7 that extends parallel to the wall component 6. In this connection, the section 11 is positioned at a spacing a from the continuous wall section 6. In regard to other features and reference numerals, the embodiment according to FIG. 5 is identical to that of FIGS. 2 to 4.

Figure 6:
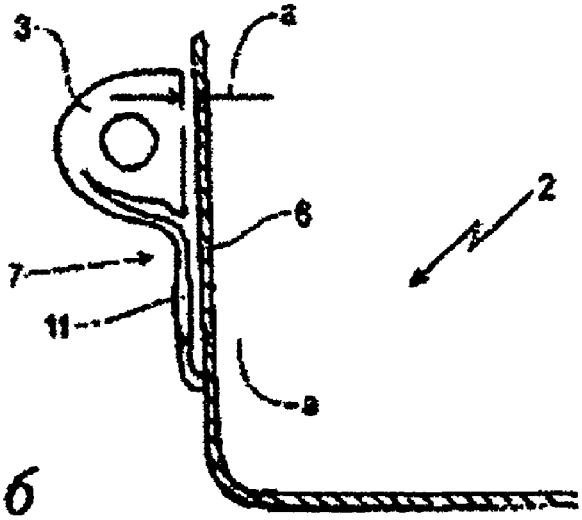
FIG. 6 is a section illustration of the arrangement according to FIG. 5 with details regarding the relative arrangement of the fastening element and of the support relative to the correlated continuous wall section.

FIG. 6 shows a longitudinal section illustration of the arrangement according to FIG. 5 in the area of the fastening element 3. Accordingly, in addition to the section 11 of the cantilever 7 the fastening element 3 also extends with a straight or flat surface at a spacing a externally to the closed wall section 6 of the cover 2. It can also be expedient that the spacing between the fastening element 3 and the wall component 6 in accordance with the illustrations of FIG. 3 and FIG. 6 is different from the spacing a between the section 11 of the cantilever 7 and the wall component 6.

The specification incorporates by reference the entire disclosure of German priority document 10 2005 025 707.0 having a filing date of Jun. 4, 2005.

While specific embodiments of the invention have been shown and described in detail to illustrate the inventive principles, it will be understood that the invention may be embodied otherwise without departing from such principles.

What is claimed is:

1. A cover arrangement of a hand-held power tool, the cover arrangement comprising:

a cover having at least one fastening element that fastens the cover to a housing of the power tool;

wherein the cover has a wall component having a shape-elastic yielding support forming a monolithic part of the cover;

wherein the at least one fastening element is arranged on the support;

a guide having play for securing an edge of the cover.

2. The cover arrangement according to claim 1, wherein the wall component is a wall section of the cover and the support is a molded part of the wall section.

3. The cover arrangement according to claim 1, wherein the support is a cantilever having a first end connected to the wall component and a second end that is a free end, wherein the at least one fastening element is connected to the free end.

4. The cover arrangement according to claim 1, wherein the support has different flexural strengths about different cross-sectional axes.

5. The cover arrangement according to claim 1, wherein the support is curved or angled.

6. The cover arrangement according to claim 1, wherein the support has a free end positioned at a spacing from the wall component, wherein the free end of the support has an inner side facing the wall component, and wherein the fastening element is arranged on the inner side.

7. The cover arrangement according to claim 1, wherein the support has a free end, and wherein the fastening element and the free end form a monolithic part.

8. The cover arrangement according to claim 1, wherein the support and the wall component are comprised of the same material.

9. The cover arrangement according to claim 8, wherein the support and the wall component are injection-molded from thermoplastic plastic material.

10. A cover arrangement of a hand-held power tool, the cover arrangement comprising:

a cover having at least one fastening element that fastens the cover to a housing of the power tool;

wherein the cover has a wall component having a shape-elastic yielding support forming a monolithic part of the cover;

wherein the at least one fastening element is arranged on the support;

wherein the support has at least a section that extends parallel to the wall component;

wherein the at least one section extending parallel to the wall component is separated by lateral slots from the wall component, and wherein the wall component and the at least one section are positioned in a common plane;

wherein one end of the lateral slots ends in a rounded widened portion, respectively.

11. A cover arrangement of a hand-held power tool, the cover arrangement comprising:

a cover having at least one fastening element that fastens the cover to a housing of the power tool;

wherein the cover has a wall component having a shape-elastic yielding support forming a monolithic part of the cover;

wherein the at least one fastening element is arranged on the support;

wherein the support has at least a section that extends parallel to the wall component;

wherein the at least one section extending parallel to the wall component is positioned at a spacing from a plane in which the wall component extends.

12. A cover arrangement of a hand-held power tool, the cover arrangement comprising:

a cover having at least one fastening element that fastens the cover to a housing of the power tool;

wherein the cover has a wall component having a shape-elastic yielding support forming a monolithic part of the cover;

wherein the at least one fastening element is arranged on the support;

wherein the fastening element is an eye-shaped screw receptacle that, in the mounted state of the cover, rests flat on a screw flange of the housing and is fixedly connected by a screw connection to the screw flange.

* * * * *